US007074452B2

(12) United States Patent
Lebowitz

(10) Patent No.: US 7,074,452 B2
(45) Date of Patent: Jul. 11, 2006

(54) METHOD AND APPARATUS FOR INDIVIDUAL FROZEN BEVERAGE MOLD AND DISPENSER

(76) Inventor: Gary Lebowitz, 115 Boulder Creek Rd., Darby, MT (US) 59829

( * ) Notice: Subject to any disclaimer, the term of this patent is extended or adjusted under 35 U.S.C. 154(b) by 118 days.

(21) Appl. No.: 10/835,837

(22) Filed: Apr. 30, 2004

(65) Prior Publication Data

US 2004/0255600 A1 Dec. 23, 2004

Related U.S. Application Data

(60) Provisional application No. 60/480,620, filed on Jun. 21, 2003.

(51) Int. Cl.
*A23P 1/10* (2006.01)

(52) U.S. Cl. ..... 426/515; 222/390; 222/391

(58) Field of Classification Search ..... 426/115, 426/515, 179; 401/150; 206/385, 817; 222/386, 222/390, 391; 425/803, DIG. 32
See application file for complete search history.

(56) References Cited

U.S. PATENT DOCUMENTS 2,457,342 A * 12/1948 Braselton ..... 401/11
2,818,167 A * 12/1957 McKinley ..... 401/75
3,595,449 A * 7/1971 Stump et al. ..... 222/386
3,993,226 A * 11/1976 Pavenick ..... 222/327
4,298,036 A * 11/1981 Horvath ..... 141/1
4,580,920 A * 4/1986 Schmidt ..... 401/175
4,664,547 A * 5/1987 Rosenwinkel ..... 401/175
4,865,480 A * 9/1989 Reynolds et al. ..... 401/175
5,839,622 A * 11/1998 Bicknell et al. ..... 222/390
6,152,632 A * 11/2000 Shimakage et al. ..... 401/72

OTHER PUBLICATIONS

Written Opinion of the International Searching Authority, for International application No. PCT/US2004/04019873 dated Dec. 8, 2005.

* cited by examiner

*Primary Examiner*—Joseph S. Del Sole
*Assistant Examiner*—Emmanuel S. Luk
(74) *Attorney, Agent, or Firm*—Merchant & Gould, LLC

(57) ABSTRACT

Method and apparatus used for the molding and dispensing of frozen beverages are provided. The apparatus includes a body cavity having an inner surface for molding a frozen beverage, an open end for dispensing the frozen beverage, and a bottom end. The apparatus further includes a rotatable threaded rod axially arranged within the body cavity, a rotatable base in fixed connection with the threaded rod to facilitate rotation of the threaded rod. Additionally the apparatus includes a moveable support in contact with the threaded rod such that the support moves within the body cavity upon rotation of the threaded rod, and an attachable cap. The method involves filling a body cavity with an unfrozen beverage, freezing the unfrozen beverage within the body cavity to mold the frozen beverage; and twisting a threaded rod in a first direction to dispense the frozen beverage from the body cavity.

25 Claims, 10 Drawing Sheets

METHOD AND APPARATUS FOR INDIVIDUAL FROZEN BEVERAGE MOLD AND DISPENSER

CROSS REFERENCE TO RELATED APPLICATIONS

This application is related to co-pending U.S. provisional patent application entitled "Method and Apparatus for Individual Frozen Beverage Mold and Dispenser" filed on Jun. 21, 2003 and accorded Ser. No. 60/480,620, which is entirely incorporated herein by reference.

FIELD OF THE INVENTION

The present invention generally relates to an apparatus used for the making of molded frozen beverages. More particularly, this invention relates to a method and apparatus for the combined molding and dispensing of frozen beverages. The apparatus includes a threaded rotating axis rod about which a moveable support, such as a threaded disk, moves upward or downward according to the clockwise or counter-clockwise movement of the axis rod. When the apparatus has a volume of frozen beverage within a body cavity, the turning movement of the axis rod combined with the upward movement of the moveable support facilitates the disbursement of the beverage in a solidified frozen molded form.

BACKGROUND OF THE INVENTION

It has been appreciated that frozen beverage molds have been in use for many years. Typically, frozen beverage molds are comprised of multiple parts, usually a tray with cavities, stick handles, and handle cover support(s). Sometimes separable cavities are included, which are placed in a tray adding yet another piece to the apparatus.

It has been recognized that the related art of frozen beverage molds are cumbersome and inefficient in nature. They are not individual apparatus but to the contrary are generally dependent on multi-cavity trays. The tray style is not space efficient since it requires a level and vertical positioning within the freezer space, which often times is at a premium within the typically crowded freezer appliance. The removal process of a frozen beverage from its mold is generally accomplished by running warm water over the removable or tray bound molds, a cumbersome process. Additionally, if the right conditions of position and temperature are not achieved the stick handle can be withdrawn without the frozen beverage attached rendering the frozen beverage inaccessible.

There is a present need for a beverage molding method and apparatus that substantially departs from conventional concepts and designs, such as the cumbersome tray based storage systems and removal process of the related art. It is respect to these considerations and others that the present invention has been made.

SUMMARY OF THE INVENTION

The method and apparatus for an individual frozen beverage mold and dispenser according to embodiments of the present invention substantially departs from the conventional concepts and designs of the related art. Thus, in so doing supplies a self contained, all inclusive method and apparatus developed for the purpose of providing the dual function of both molding and dispensing. This eliminates the cumbersome tray based storage system and removal process as required of the related art.

In view of the foregoing disadvantages inherent in the known types of frozen beverage molds now present in the related art, the present invention provides a new method and apparatus used for the making and dispensing of molded frozen beverages. All of the known systems for the making of molded frozen beverages are not self-inclusive in method and apparatus combined.

It is a principal object of certain embodiments of the present invention, but not necessarily all embodiments, to provide apparatus that is self-inclusive in both method and apparatus.

It is a principal object of certain embodiments of the present invention, but not necessarily all embodiments, to provide the dual function of providing both molding apparatus and dispenser in one.

It is a principal object of certain embodiments of the present invention, but not necessarily all embodiments, to allow an unrestricted, multi-angle, space saving placement within the freezer. A space efficient apparatus to fit within the freezer space in any position suitable to the available space is provided.

It is a principal object of certain embodiments of the present invention, but not necessarily all embodiments, to provide the ability to stand independently upright on a support surface at any point of the consumption process thus allowing the user the choice to interrupt and pace the consumption of the frozen beverage consequently providing the option to free ones hands for other activities, if desired.

It is a principal object of certain embodiments of the present invention, but not necessarily all embodiments, through its controllable dispensing mechanism, to prevent melted frozen beverage from dripping in general and specifically on to the exterior of the apparatus and/or the users hand when in use by allowing for the retention of any melted beverage within the interior of the apparatus.

The method of using a threaded rotating axis rod about which a threaded disk moves upward or downward according to the clockwise or counter-clockwise movement of the axis rod within the relational structure of the apparatus combined with the dual use of the apparatus's cap as its handle allows the apparatus to achieve an advantageous nature of the invention.

There has thus been outlined, rather broadly, the more important features of the invention in order that the detailed description thereof may be better appreciated. There are additional features of the invention that will be described hereinafter.

The general purpose of the present invention, which will be described subsequently in greater detail, is to provide a new method and apparatus for an individual frozen beverage mold and dispenser that has many of the advantages of the frozen beverage molds mentioned heretofore and many novel features that result in a new frozen beverage mold which is not anticipated, rendered obvious, suggested, or even implied by any of the prior art frozen beverage molds, either alone or in any combination thereof.

To attain this, the present invention generally comprises a body cavity, a threaded rotating axis rod about which a threaded disk moves upward or downward according to the clockwise or counter-clockwise movement of the axis rod, an attachable and intrinsic cap with a bottle stopper style construction which may have a dual function to serve as a crankshaft style handle to facilitate the dispensing of the frozen beverage.

There has thus been outlined, rather broadly, some features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of certain embodiments of the present invention, but not necessarily all embodiments, is to provide a method and apparatus for an individual frozen beverage mold and dispenser that will overcome some of the shortcomings of the related art devices and provide an advantageous method and apparatus for the molding and dispensing of frozen beverages.

Other objects and advantages of certain embodiments of the present invention will become obvious to the reader and it is intended that these objects and advantages are within the scope of certain embodiments of the present invention, but not necessarily all embodiments.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Many aspects of the present invention can be better understood with reference to the following drawings. The components in the drawings are not necessarily to scale, emphasis instead being placed upon clearly illustrating the principles of embodiments of the present invention. Moreover, in the drawings, like reference numerals designate corresponding parts throughout the several views. Thereof, reference being made to the accompanying drawings in which:

FIG. 7B is drawn as if the body cavity of the apparatus is constructed of a transparent material;

DETAILED DESCRIPTION

Figure 1:
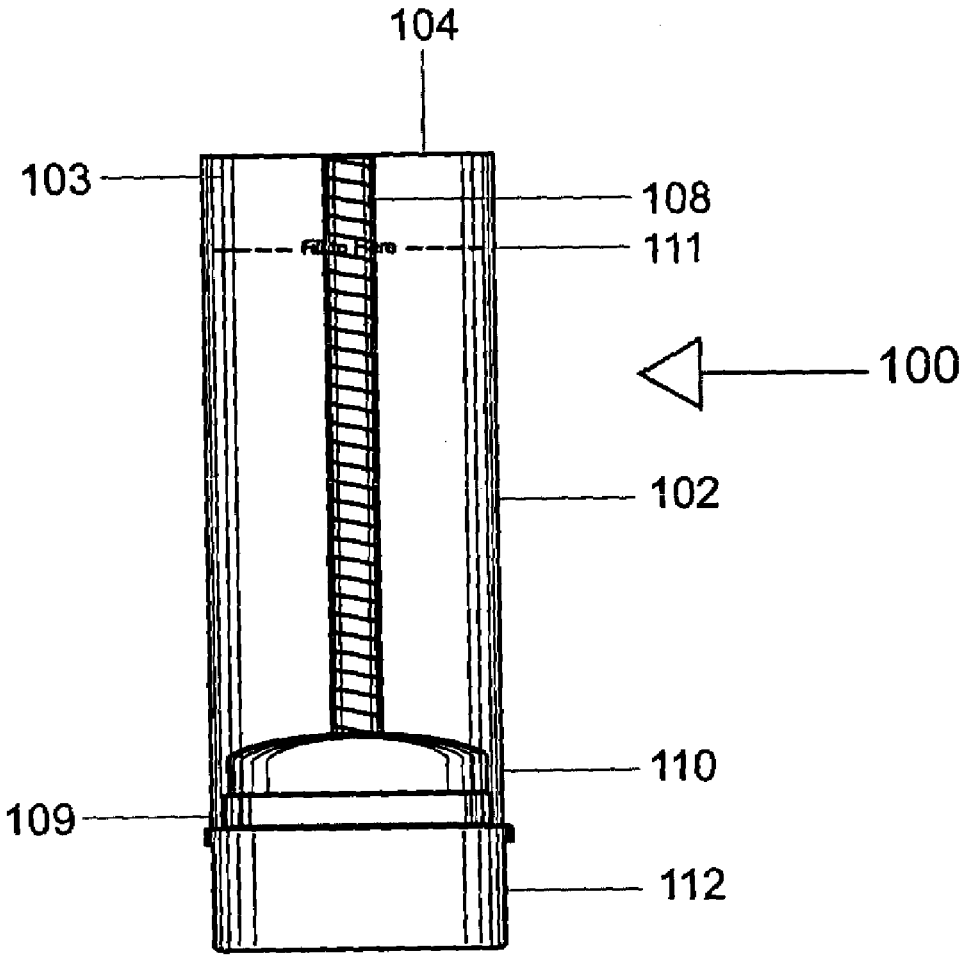
FIG. 1 is a front view of a frozen beverage mold and dispenser apparatus according to an embodiment of the present invention. This figure is drawn as if a body cavity of the apparatus is constructed of a transparent material.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated wherein, which would occur to one skilled in the relevant art and having possession of this disclosure, are to be considered within the scope of the invention.

Turning now descriptively to the drawings, the attached figures illustrate a method and apparatus for molding and dispensing frozen beverages. It should be understood that for the purposes of describing embodiments of the present invention, the term beverage is defined as any substance safe for drinking or eating that tends to flow and conforms to the outline of its container. The intention of the present invention is to fill the body cavity of the apparatus with an unfrozen beverage, such as a liquid beverage, store the apparatus in a freezer appliance and subsequently remove the apparatus, with its contents frozen, for consumption, through the use of its rotating dispensing mechanism, such as a rod/disk mechanism, allowing the apparatus to serve additionally as a dispenser.

FIG. 1 is a front view of a frozen beverage mold and dispenser apparatus 100 according to an embodiment of the present invention. The apparatus 100 includes a body cavity, such as a barrel cavity 102, having an inner surface 103 for molding a frozen beverage. This figure is drawn as if the barrel cavity 102 is constructed of a transparent material. The barrel cavity 102 also has an open end 104 for dispensing the frozen beverage, a suggested fill line 111, and a bottom end 109. The apparatus 100 also includes a threaded rod 108 axially arranged within the barrel cavity 102 and vertically extended from the bottom end 109 toward the open end 104. The threaded rod 108 is capable of being rotated.

Additionally, the apparatus 100 includes a rotatable base 112 in fixed connection with the threaded rod 108 to facilitate rotation of the threaded rod 108. The rotatable base 112 is also rotatably coupled to the barrel cavity 102 to facilitate movement of a moveable support, such as a threaded disk 110. The threaded disk 110 is in contact with the threaded rod 108 in a manner such that the threaded disk 110 moves within the barrel cavity 102 upon rotation of the threaded rod 108. Further, the apparatus 100 may include one or more seals, such as an O-ring (not shown in FIG. 1) for sealing the barrel cavity 102 so that the frozen beverage in unfrozen or melted form is retained within the barrel cavity 102. It should also be appreciated that the juncture between the threaded rod 108 and the bottom end 109 of the body cavity 102 may also be configured to prevent leakage of melted beverage with or without a separate seal, such as by double injection molding at one or more of the juncture points on the threaded rod 108 and/or the bottom end 109.

Figure 2:
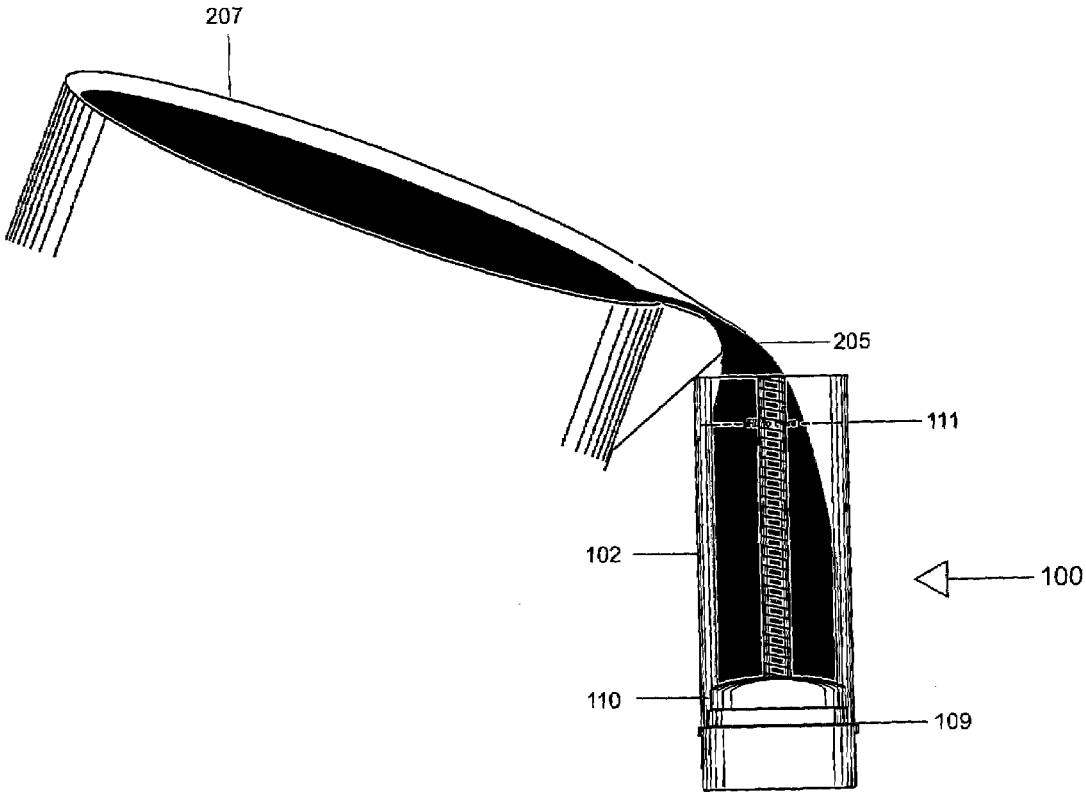
FIG. 2 is a front view of the apparatus of FIG. 1 during the process of filling the apparatus with a beverage to be frozen according to an embodiment of the present invention. This figure is drawn as if the body cavity of the apparatus is constructed of a transparent material.

Referring now to FIG. 2, a method of filling the apparatus 100 with a beverage to be frozen 205 may be accomplished by pouring the beverage 205 into the barrel cavity 102 of the apparatus 100 from a container 207. The barrel cavity 102 has the suggested fill line 111 to facilitate filling of the maximum amount of beverage capacity. The threaded disk 110 is lowered to the bottom end 109 of the barrel cavity 102 prior to freezing the beverage 205.

Figure 3A:
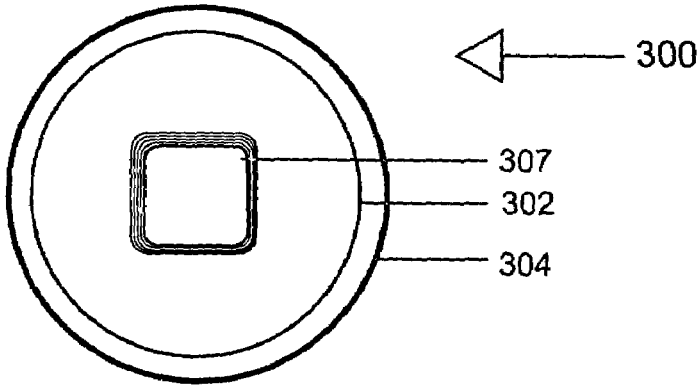
FIGS. 3A–3C respectively illustrate bottom, perspective, and cross sectional views of an attachable cap of a frozen beverage mold and dispenser apparatus according to another embodiment of the present invention.
Figure 3B:
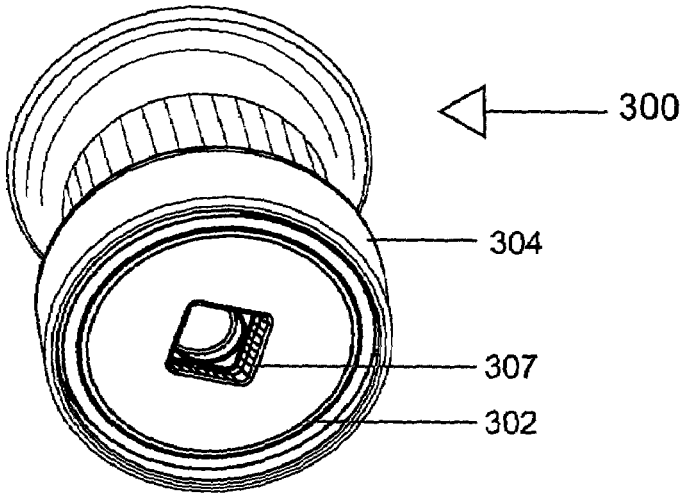
Figure 3C:
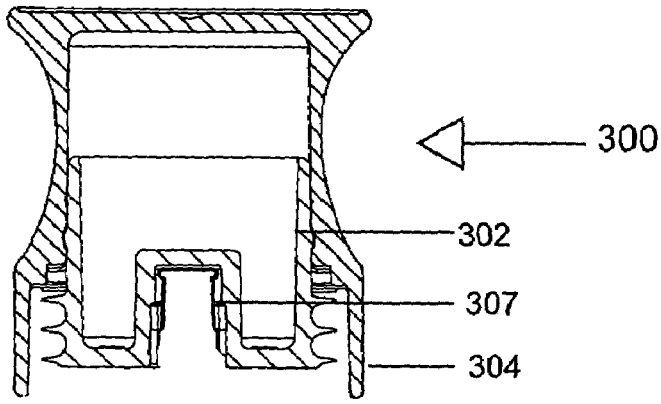

Turning now to FIGS. 3A–3C, an attachable cap 300 for sealing the barrel cavity 102 according to another embodiment of the present invention will be described. The attachable cap 300 includes an internal part 302, and external part 304 and a recessed cavity, such as a recessed fitting 307 for accommodating the threaded rod 108 upon insertion of the attachable cap 300 in the barrel cavity 102 (shown in FIG. 1). The internal part 302 of the attachable cap 300 is designed without threads as a flexible bottle stopper style insert for the purpose of providing a tight seal simultaneously with the ability to move upwards along the inner surface 103 (shown in FIG. 1), such as the inner walls of the barrel cavity 102 (shown in FIG. 1).

Figure 4:
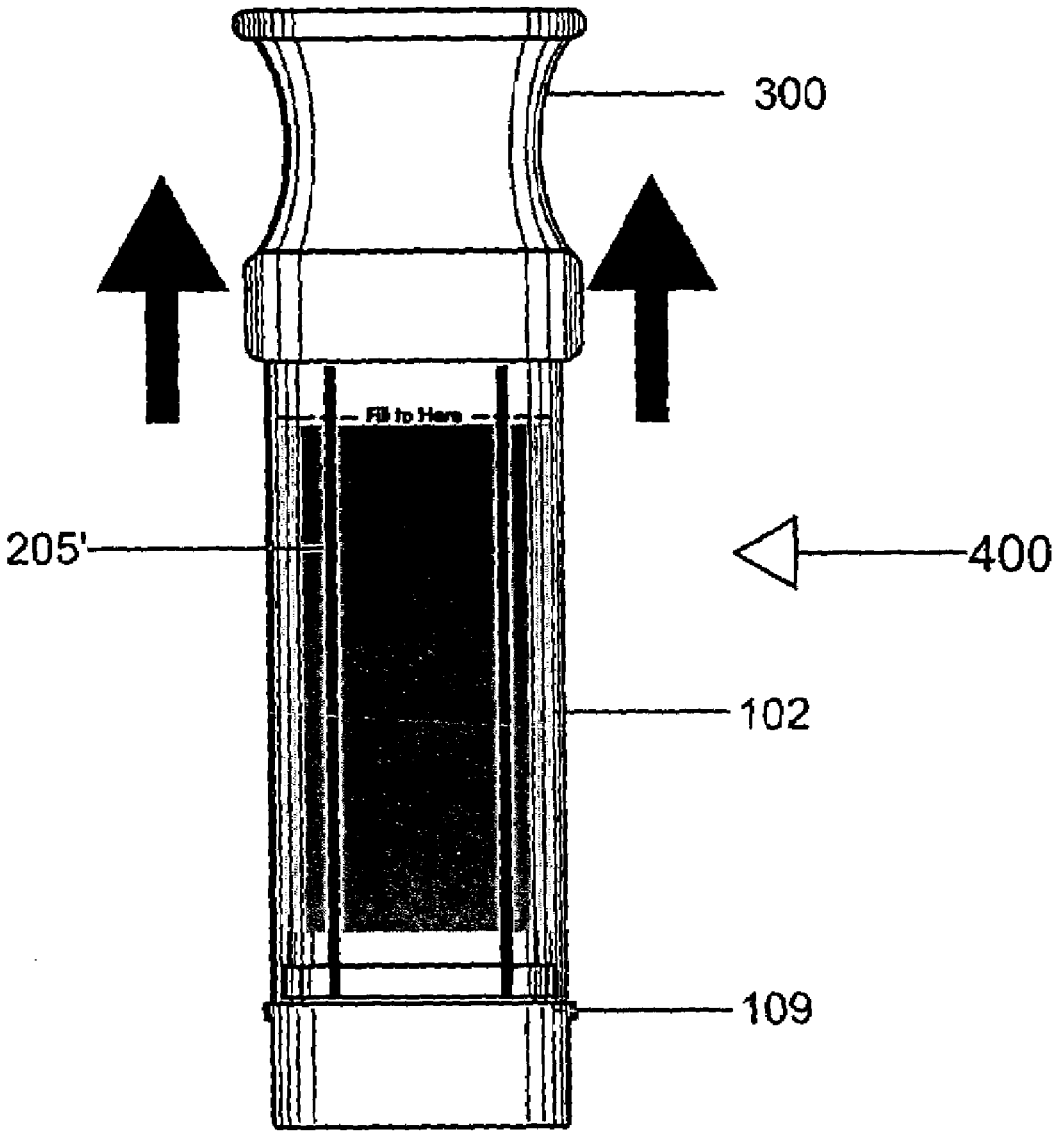
FIG. 4 is a front view of the apparatus during freezing and filled with a frozen beverage illustrating upward movement of the attachable cap of FIGS. 3A–3C in response to expansion of the beverage during the freezing process according to an embodiment of the present invention.

FIG. 4 is a front view of an apparatus 400 during freezing and filled with a frozen beverage 205' illustrating upward movement of the attachable cap 300 of FIGS. 3A–3C in response to expansion of the beverage 205 during the freezing process according to an embodiment of the present invention. The upward movement of the attachable cap 300 accommodates the anticipated expansion of the beverage 205 as it transforms to its solidified frozen state. The combination of the beverage filled to the fill line 111 (shown in FIG. 1) and the attachable cap 300 complementarily received and pushed down to its full extent on to the open end 104 of the barrel cavity 102 insures a uniformly shaped frozen beverage 205' upon dispensing of the frozen beverage. Due to the ability of the attachable cap 300 to move up the barrel cavity 102 incrementally as the beverage 205 freezes and expands, the uniform shape is insured regardless of the apparatus's 400 orientation or angle when placed in a freezer appliance.

Figure 5:
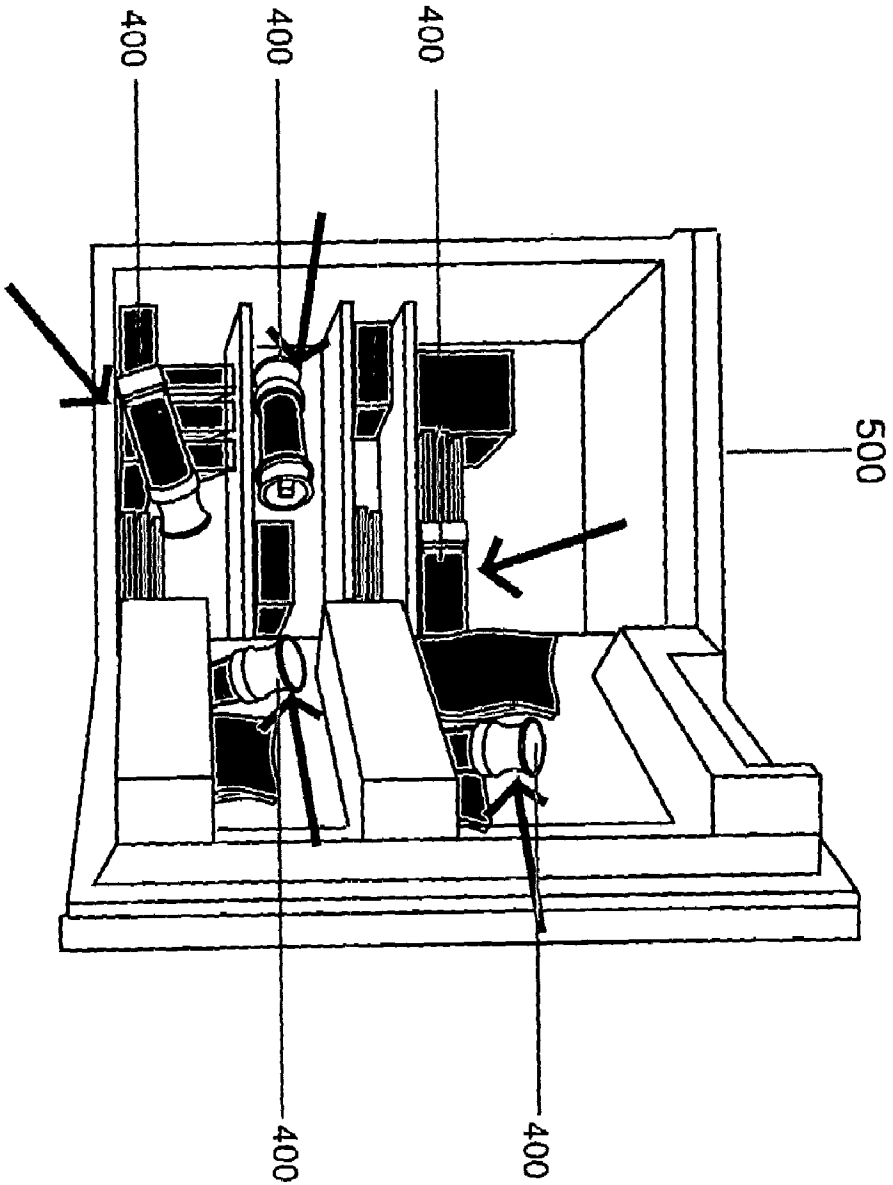
FIG. 5 is a perspective view of multi-angle placement of the apparatus in a freezer appliance according to an embodiment of the present invention.

Turning now to FIG. 5, a perspective view of multi-angle placement of the apparatus 400 in a freezer appliance 500 according to an embodiment of the present invention will be described. The apparatus 400 also provides and advantage in storage over other related art. Due to its self contained individual design, each apparatus 400 allows for flexible multi-angle placement in any available space within the freezer appliance 500. Consequently a variety of areas within the freezer appliance 500 can be used in a random manner for the utmost space efficiency. Upon solidification of the beverage to its frozen state, the beverage is ready for its intended consumption and the apparatus 400 is removed from the freezer appliance 500.

Figure 6A:
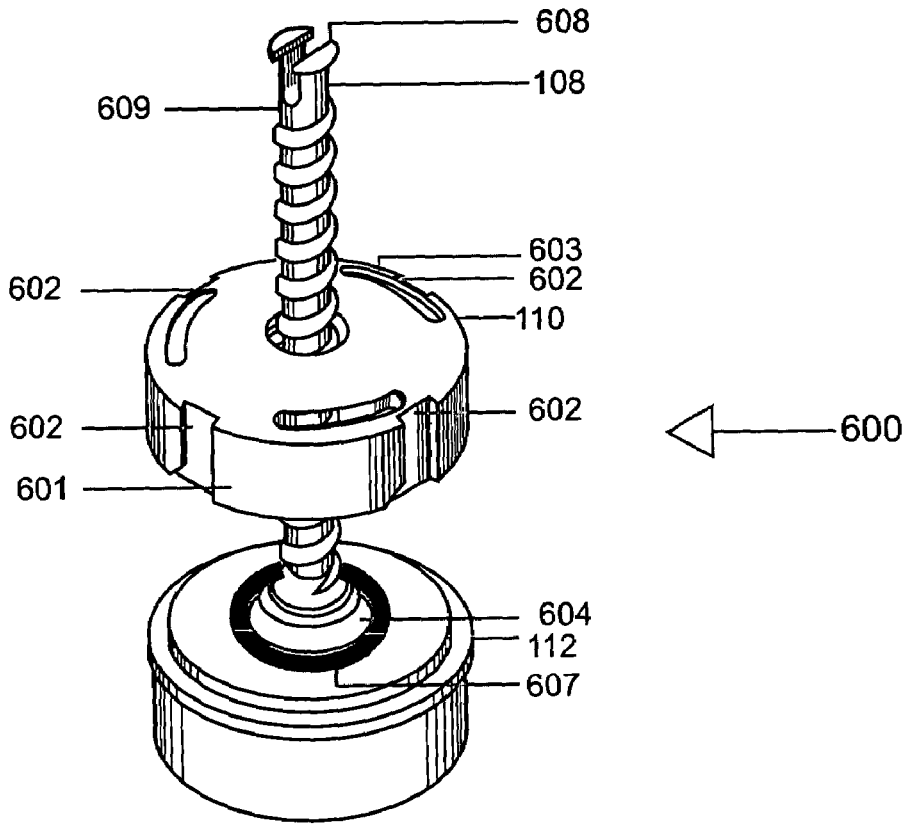
FIGS. 6A–6B are respectively a perspective view of a dispensing mechanism for dispensing the frozen beverage from the apparatus and a cross sectional view of a threaded disk of the dispensing mechanism according to embodiments of the present invention.
Figure 6B:
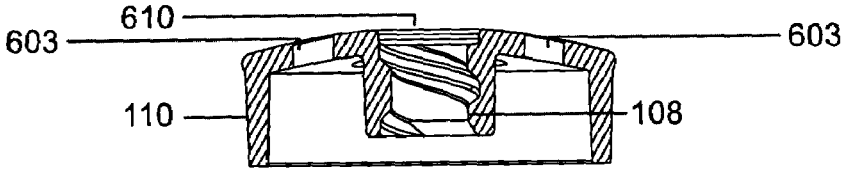

FIGS. 6A–6B are a perspective view of a dispensing mechanism for dispensing the frozen beverage from the apparatus 400 (shown in FIG. 4) and a cross section of the threaded disk 110 according to an embodiment of the present invention The method of dispensing the frozen beverage 205' is accomplished by a dispensing mechanism, such as a rotating rod/disk mechanism 600. The threaded disk 110 and the threaded rod 108 are in threaded engagement to dispense the frozen beverage 205' (shown in FIG. 4). The threaded disk 110 may be placed in position on the threaded rod 108 over flexible prongs 608 at the tip of the threaded rod 108. The threads 610 of the threaded disk 110 are illustrated in FIG. 6B. As the rotatable base 112, in fixed connection with the threaded rod 108, is rotated in a first direction, such as a counter-clockwise direction, the threaded rod 108 rotates and the threaded disk 110, in threaded engagement with the threaded rod 108, moves upward along the threaded rod 108.

As the threaded disk 110 moves upward, it may come to an auto-stop at the top of the threaded rod 108 equipped with a means, such as the flexible prongs 608, that allows the threaded disk to spin over a threadless portion 609 near the tip of the threaded rod 108. The threaded rod 108 further includes a flange 604 rotatably connected to the bottom end 109 of the body cavity 102 (shown in FIG. 4). It should be appreciated that the rotating connection between the flange 604 and the bottom end 109 may be reinforced by a sustainable fit, such as a low tolerance and/or high torque press fit. The sustainable fit is utilized to counter any force necessary to initially move the frozen beverage 205' up the barrel cavity 102 (shown in FIG. 4) upon initially rotating the rotatable base 112 after freezing.

The rotating rod/disk mechanism 600 also includes one or more seals, such as an O-ring 607 for insertion between the flange 604 of the threaded rod 108 and the bottom end 109 of the body cavity 102 (shown in FIG. 4). The seal 607 helps prevent dripping of a melted frozen beverage in general and specifically helps prevent dripping on to the exterior of the apparatus 400 or hands of a user when the apparatus 400 is in use by allowing for retention of any melted beverage within the interior of the body cavity 102. It should also be appreciated that the juncture between the threaded rod 108 and the bottom end 109 of the body cavity 102 (shown in FIG. 4) may also be configured to prevent leakage of melted beverage, such as by double injection molding at one or more of the juncture points. Additional details regarding juncture points will be described below with respect to FIGS. 7C.

In the present embodiment the threaded disk 110 also includes perforated openings or holes 603 to facilitate cleaning and multiple use of the apparatus 400. The perforated openings 603 may be in a variety of shapes, such as circular or slotted. Still further, the threaded disk 110 includes an outer surface 601 having indentations 602 for interfacing with support guides (shown in FIGS. 7A–7B) within the body cavity 102. Additional details regarding support guides and indentations 602 will be described below with respect to FIGS. 7A–7B.

Figure 7A:
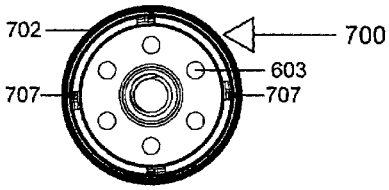
FIGS. 7A–7C are a top, perspective, and an exploded perspective view, respectively, of the apparatus illustrating a second function of the attachable cap of FIGS. 3A–3C as a handle for dispensing the frozen beverage and support guides within a body cavity of the apparatus according to another embodiment of the present invention.
Figure 7B:
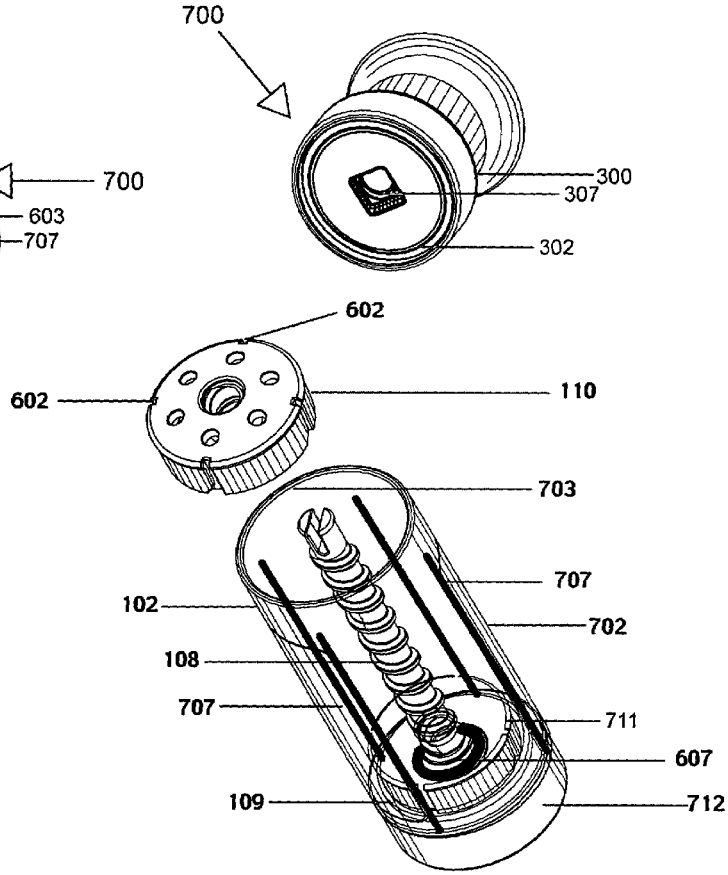
Figure 7C:
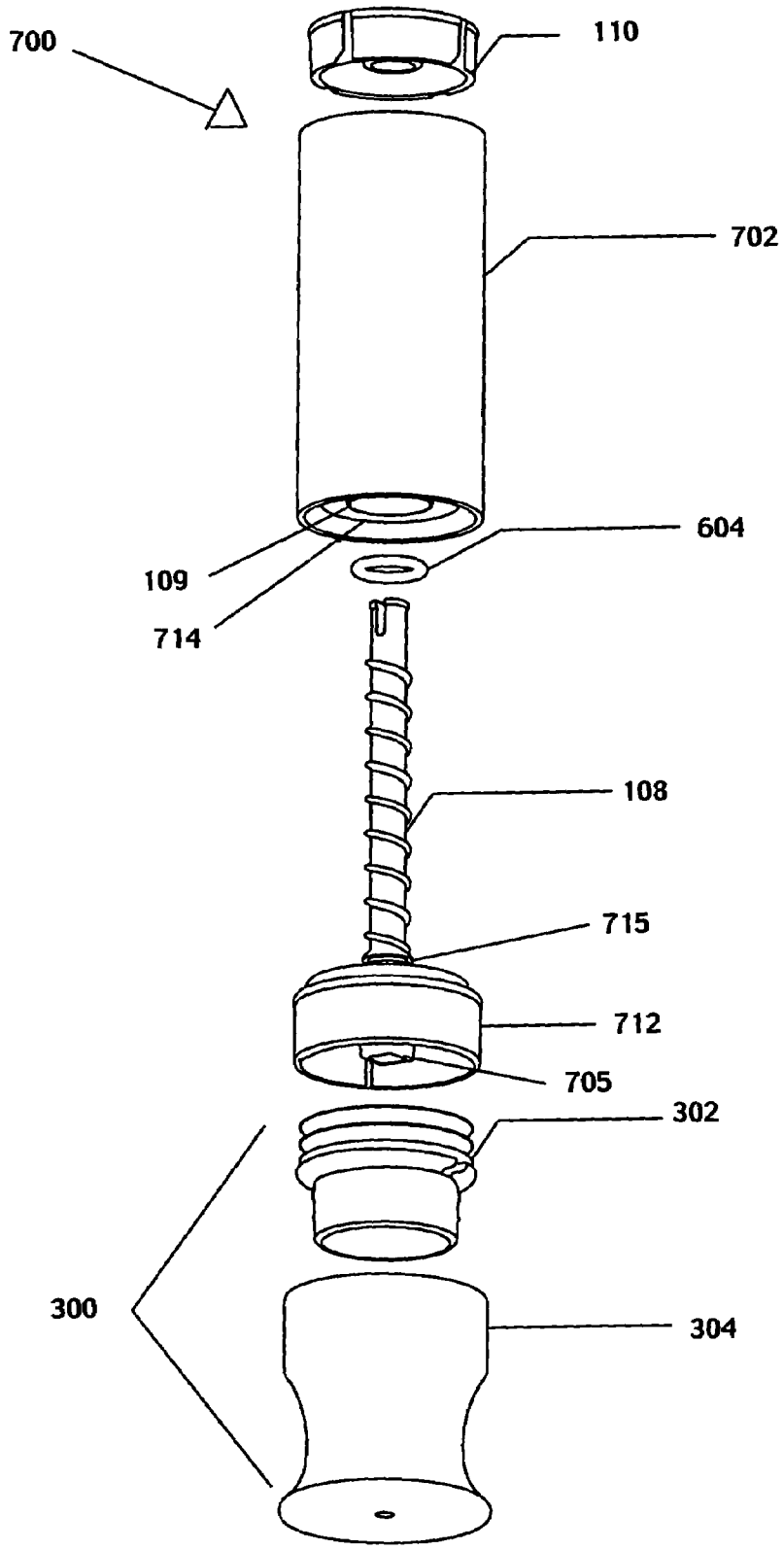

Referring now to FIGS. 7A–7C, a top, perspective view, and an exploded perspective view of an apparatus 700 illustrating support guides 707, a platform 711 extended from the bottom end 109 of the body cavity, juncture points 714 and 715, and a second function of the attachable cap 300 of FIGS. 3A–3C as a handle for dispensing the frozen beverage 205' according to another embodiment of the present invention will be described. The apparatus 700 having at least one support guide 707 in parallel with and extended from an inner wall 703 of the body cavity 702 is illustrated in FIGS. 7A–7B. The support guides 707 interface with the indentations 602 and add stability to the moveable support 110 as it moves upward and downward within the body cavity 702.

Further, a platform 711 extended upward from the bottom end 109 of the body cavity is formed to complimentarily receive the moveable support, such as the threaded disk 110, when retracted. The platform helps prevent excess seepage of beverage from accumulating under the threaded disk 110 during the freezing process.

The apparatus 700 illustrated in FIGS. 7B–7C also includes the attachable cap 300. The internal part 302 of the attachable cap 300 incorporates the recessed fitting 307, for example a non-cylindrical fitting, which surrounds a protruding extension 705, for example a non-cylindrical extension, in fixed connection with the threaded rod 108 via a rotatable base 712 rotatably coupled to the barrel cavity 702. The attachable cap 300 is detachably mounted at and complementarily received by the rotatable base 712, which consequently turns the threaded rod 108 upon the turning of the attachable cap 300. Thus, the attachable cap 300 also serves as an attachable handle that facilitates rotation of the threaded rod 108 and dispensing/retracting of the frozen beverage 205' upon rotation of the attachable handle.

Also as briefly described above, juncture points 714 at the bottom end 109 and 715 at the bottom of the threaded rod may be formed to seal the barrel cavity 702 with or without a separate seal, such as the O-ring 607. For instance, double injection molding at the juncture points 714 and 715 can provide the necessary seal to prevent leakage from the barrel cavity 702.

Figure 8:
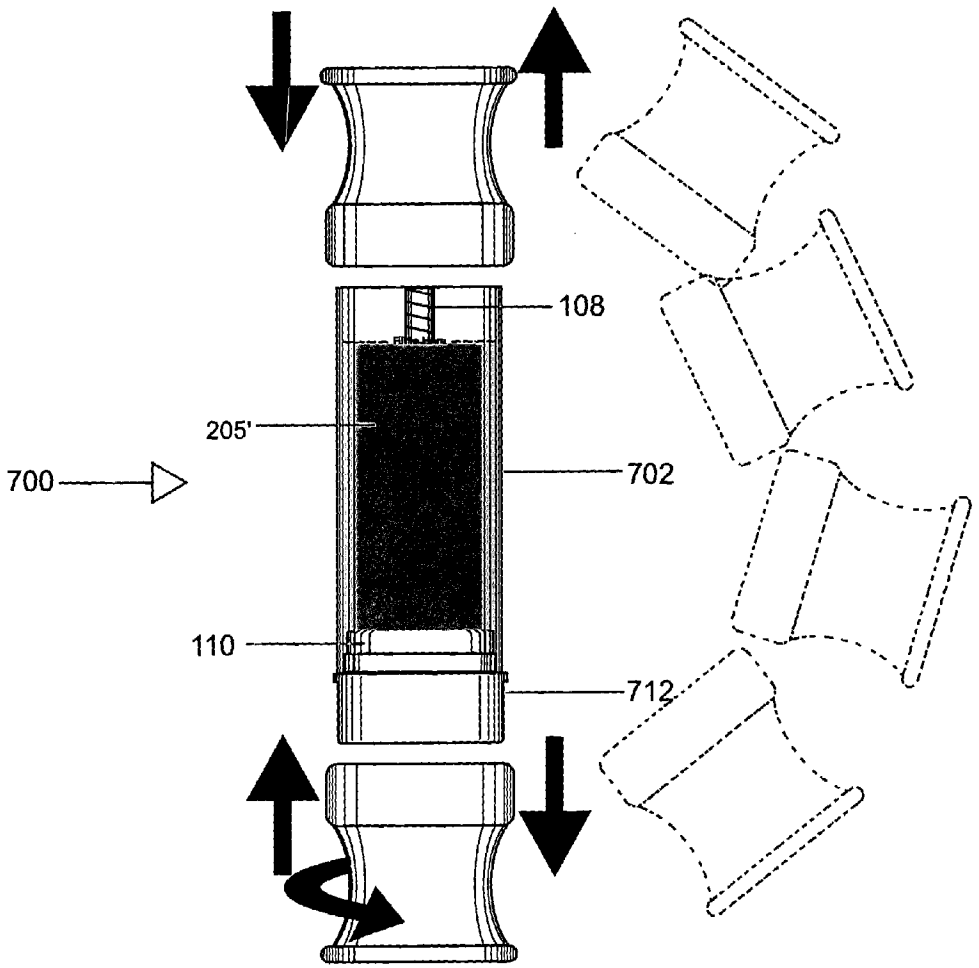
FIG. 8 is a front view of the assembled apparatus of FIG. 7B illustrating the dual functions of the attachable cap of FIGS. 3A–3C for sealing the apparatus and dispensing the frozen beverage according to an embodiment of the present invention. This figure is drawn as if the body cavity of the apparatus is constructed of a transparent material.

FIG. 8 is an assembled front view of the apparatus 700 of FIGS. 7A–7C illustrating the dual functions of the attachable cap 300 of FIGS. 3A–3B for sealing the apparatus 700 and dispensing the frozen beverage 205' according to an embodiment of the present invention. This figure is drawn as if the barrel cavity 702 is constructed of a transparent material. When the attachable cap 300 is removed from the top of the barrel cavity 702 and fitted to the rotatable base 712, the attachable cap 300 is subsequently being used as a handle and impeller to dispense the frozen beverage 205'. For instance, a counter-clockwise movement of the attachable cap 300 impels the threaded disk 110 to move upward on the threaded rod 108 while a clockwise movement impels the threaded disk 110 to move downward on the threaded rod 108. Additional details regarding dispensing the frozen beverage will be described below with respect to FIGS. 9 and 10.

Figure 9:
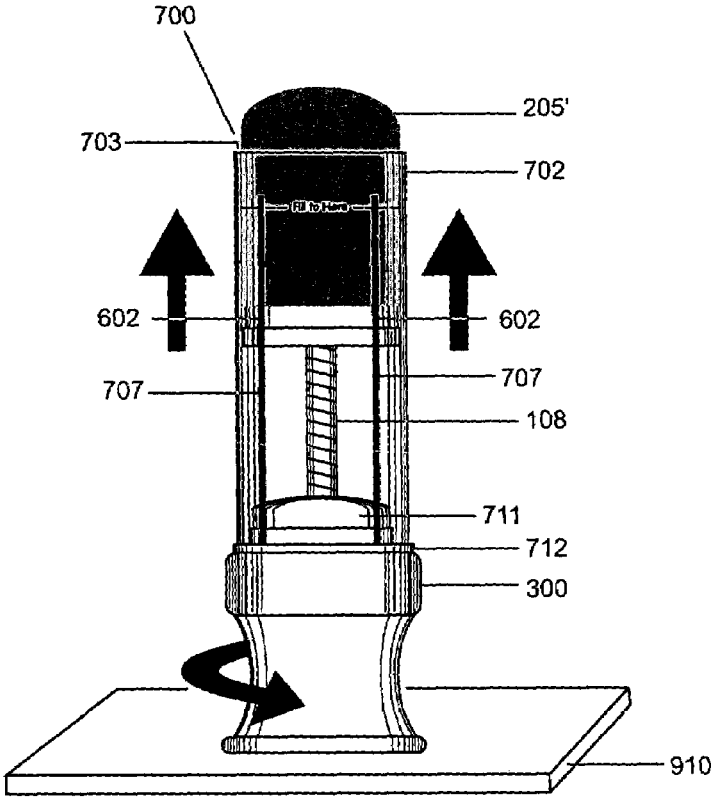
FIGS. 9 and 10 are front views of the apparatus illustrating use of the attachable cap in dispensing and retracting the frozen beverage and stabilizing the mold and dispenser according to an embodiment of the present invention. These figures are drawn as if the body cavity of the apparatus is constructed of a transparent material.
Figure 10:
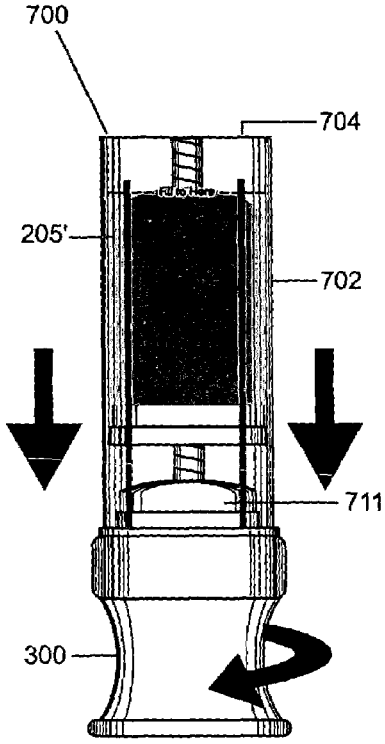

FIGS. 9 and 10 are front views of the apparatus of FIGS. 7A–7C illustrating use of the attachable cap 300 in dispensing and retracting the frozen beverage 205' according to an embodiment of the present invention. These figures are drawn as if the barrel cavity 702 is constructed of a transparent material. The dispensing of the frozen beverage 205' which has molded to the shape of the barrel cavity 702 is facilitated by the rod/disk mechanism 600 (shown in FIG. 6) in a controllable manner. Since the apparatus 700 has the ability to interchange the attachable cap 300 between the top of the barrel cavity 702 and the bottom of the rotatable base 712, the highly controllable design allows the user to both control the pace and exposure of the frozen beverage 205' for consumption. This control allows the user to reverse the exposure of the frozen beverage 205', if desired, in order to prevent spillage of any melted portion of the exposed frozen beverage outside of the apparatus 700.

The body cavity 702 also includes the support guides 707 in parallel with and extended from the inner surface 703 of the body cavity 702 and interfaced with the indentations 602 of the threaded disk 110 whereby the threaded disk 110 has added stability while moving within the body cavity 702.

Additionally, if any accumulation of melted frozen beverage within the barrel cavity 702 of the apparatus 700 occurs, the user can choose from two options, one being to consume the liquefied remains by tipping the open end 704 of the barrel cavity 702 of the apparatus 700 to drain its contents. Option two being to place the attachable cap 300 in its cap position to seal the contents within the apparatus 700. Both options provide an advantage over other related art in cleanliness.

The apparatus 700 also provides an advantage in handling over other related art. The ability of the apparatus to stand independently upright on a support surface 910 at any point of the consumption process thus allowing the user the choice to interrupt and pace the consumption of the frozen beverage 205' consequently providing the option to free ones hands for other activities, if desired, a freedom that other related art does not provide. Subsequently, the attachable cap 300 is turned counter-clockwise in increments comfortable to the user for consumption until the open end 704 of the barrel cavity 702 is reached and the frozen beverage has expired.

Thus, the present invention is presently embodied as a method and apparatus for individual frozen beverage mold and dispenser.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and accordingly all suitable modifications and equivalents may be resorted to, falling within the scope of the invention.

I claim:

1. An apparatus for molding and dispensing a frozen beverage comprising:

a body cavity having an inner surface for molding a frozen beverage during a freezing process, having an open end for dispensing the frozen beverage, and having a bottom end;

a threaded rod axially arranged within the body cavity and vertically extended from the bottom end toward the open end wherein the threaded rod is rotatably engaged with the bottom end in a maimer that prevents leakage from the body cavity of the frozen beverage while the frozen beverage is in at least one of poured liquid form and melted form;

a rotatable base in fixed connection with the threaded rod to facilitate rotation of the threaded rod and rotatably coupled to the body cavity;

a moveable support wherein the support is engaged with the threaded rod such that the support moves the frozen beverage at least one of upward and downward within the body cavity upon rotation of the threaded rod;

a retention element for restricting upward movement of the moveable support;

an attachable cap detachably mounted to and complementarily received at the open end of the body cavity, the attachable cap having an internal part wherein the internal part is inserted into the open end of the body cavity to provide a tight seal and move upwards along the inner surface of the body cavity in response to an expansion of the frozen beverage within the body cavity and whereby the frozen beverage in unfrozen form is retained within the body cavity.

2. The apparatus of claim 1, wherein the rotatable base further includes a protruding extension in fixed connection with the threaded rod and wherein the internal part of the attachable cap further includes a recessed fitting capable of surrounding the protruding extension and wherein the attachable cap further comprises an attachable handle detachably mounted to and complementarily received by the rotatable base such that the recessed fitting surrounds the protruding extension in a manner that facilitates rotation of the threaded rod and dispensing of the frozen beverage upon rotation of the attachable handle.

3. The apparatus of claim 1, further comprising a fill line on the body cavity indicating a maximum amount of unfrozen beverage capacity such that when the unfrozen form of the frozen beverage fills the body cavity to the fill line and the attachable cap is frilly inserted into the open end of the body cavity a uniformly shaped frozen beverage is insured at any angle which the body cavity filled with the unfrozen beverage is stored and the unfrozen beverage is frozen.

4. The apparatus of claim 1, wherein the internal part of the attachable cap movably seals the body cavity whereby a flexible bottle stopper style insert seal is provided.

5. The apparatus of claim 2, wherein the recessed fitting comprises a non-cylindrical fitting and the protruding extension comprises a non-cylindrical extension whereby a crankshaft style attachable handle is implemented.

6. The apparatus of claim 1, wherein the threaded rod further includes at least one of the following:

at least one flexible prong without threads to automatically stop the support from being separated from the threaded rod while rotating the threaded rod and to facilitate manual removal of the support from the threaded rod; and a flange rotatably connected to the bottom end of the body cavity wherein the apparatus further includes at least one of the following:

at least one seal inserted between the flange of the threaded rod and the bottom end of the body cavity; and a double injection molded juncture between the threaded rod and the bottom end whereby dripping of a melted frozen beverage is prevented on to the exterior of the apparatus or on hands of a user when the apparatus is in use by allowing for retention of any melted beverage within the interior of the body cavity.

7. The apparatus of claim 1, wherein the body cavity comprises a barrel cavity and the moveable support comprises a threaded disk having at least one opening to facilitate cleaning and repeated use of the apparatus.

8. The apparatus of claim 1, wherein the moveable support moves toward the open end of the body cavity upon rotation of the threaded rod in a counter-clockwise direction and wherein the movable support moves toward the bottom end of the body cavity upon rotation of the threaded rod in a clockwise direction whereby the frozen beverage is either dispensed by moving the support toward the open end or retracted by moving the support toward the bottom end.

9. The apparatus of claim 1, further including a platform upwardly extended from the bottom end and formed to complimentarily receive the support when the support is retracted in order to prevent excess seepage of unfrozen beverage from accumulating under the support during freezing.

10. The apparatus of claim 1, wherein the support further includes an outer surface having indentations and wherein the body cavity further includes support guides in parallel with and extended from the inner surface of the body cavity such that the support guides interface with the indentations of the outer surface of the support whereby the support has added stability while moving within the body cavity.

11. The apparatus of claim 1, wherein the apparatus is substantially made from plastic and wherein at least the body cavity is transparent.

12. The apparatus of claim 1, wherein at least one of the apparatus and the rotatable base stand independently upright on a support surface thereby allowing a user to interrupt and pace consumption of the frozen beverage at any point of the consumption process and free the hands of the user for other activities.

13. A frozen beverage mold and dispenser comprising:

a barrel cavity having an open end for receiving a beverage to be frozen and dispensing a frozen beverage, having an inner surface for molding the frozen beverage, and having a bottom end;

a threaded rod axially arranged within the barrel cavity and vertically extended from the bottom end toward the open end wherein the threaded rod is capable of being rotated;

a rotatable base in fixed connection with the threaded rod to facilitate rotation of the threaded rod and rotatably coupled to the barrel cavity;

a threaded disk wherein the threaded disk is in threaded engagement with the threaded rod such that the threaded disk moves at least one of upward and downward within the body cavity upon rotation of the threaded rod; and an attachable cap detachably mounted to arid complementarily received at the open end of the barrel cavity, the attachable cap having an internal part wherein the internal part is inserted into the open end of the barrel cavity to provide a seal and move upwards along the inner surface of the barrel cavity in response to an expansion of the frozen beverage within the barrel cavity.

14. The apparatus of claim 13 further comprising a fill line on the body cavity indicating a maximum amount of unfrozen beverage capacity such that when the beverage to be frozen fills the barrel cavity to the fill line and the attachable cup is fully inserted into the open end of the barrel cavity a uniformly shaped frozen beverage is insured at any angle which the barrel cavity filled with the beverage to be frozen is stored.

15. A method for molding and dispensing a frozen beverage comprising:

filing a body cavity with an unfrozen beverage;

freezing the unfrozen beverage within the body cavity to mold the frozen beverage;

rotating a threaded rod in a first direction to dispense the frozen beverage from the body cavity wherein the threaded rod is axially arranged within the body cavity and vertically extended toward an open end of the body cavity to advance a moveable support in contact with the treaded rod and the frozen beverage toward the open end such that when the threaded rod is rotated in the first direction, the moveable support and the frozen beverage advance toward the open end of the body cavity to dispense the frozen beverage; and rotating the threaded rod in a second direction opposite to the first direction to retain at least one of the frozen beverage or melted portions of the frozen beverage within the body cavity for future consumption.

16. The method of claim 15, wherein filling the body cavity comprises filling the body cavity to a fill line on the body cavity with the unfrozen beverage and wherein prior to freezing the unfrozen beverage, the method further comprises inserting an attachable cap into the open end of the body cavity wherein inserting the attachable cap includes at least one of the following:

sealing the body cavity;

retaining the unfrozen beverage within the body cavity at any angle which the body cavity is stored; and molding a uniform shape of the unfrozen beverage at any angle which the body cavity is stored wherein the attachable cap moves within the body cavity in response to an expansion of the frozen beverage while freezing the unfrozen beverage.

17. The method of claim 16, wherein prior to rotating the treaded rod, the method further comprises removing the attachable cap.

18. The method of claim 17, wherein rotating the threaded rod comprises twisting a rotatable base rotatably coupled to the body cavity and in fixed connection with the threaded rod such that the threaded rod rotates upon twisting the rotatable base.

19. The method of claim 18, wherein rotating the rotatable base comprises:

surrounding a protruding extension in fixed connection with the rotatable base with a recessed fitting in fixed connection with the attachable cap; and twisting the attachable cap in the first direction as a handle to rotate the rotatable base in the first direction whereby the threaded rod is rotated in the first direction and the frozen beverage is dispensed via the open end of the body cavity.

20. The method of claim 16, wherein prior to freezing the unfrozen beverage, the method further comprises rotating the threaded rod in a second direction opposite the first direction such that the moveable support retracts to a bottom end of the body cavity and wherein after dispensing a portion of the frozen beverage, the method further comprises:

rotating the threaded rod in the second direction such that a remaining portion of the frozen beverage is retracted within the body cavity whereby the remaining portion is stored in the body cavity for future consumption.

21. The method of claim 20, wherein the first direction comprises a counter-clockwise direction and the second direction comprises a clockwise direction.

22. The method of claim 15, wherein freezing the unfrozen beverage comprises storing the unfrozen beverage within the body cavity in a freezer appliance and wherein prior to dispensing the frozen beverage, the method further comprises removing the body cavity containing the frozen beverage from the freezer appliance.

23. A method for molding and dispensing frozen beverages comprising: providing a frozen beverage mold and dispenser comprising:

a barrel cavity having an open end and a bottom end, a threaded rod axially arranged within to barrel cavity from the bottom end to the open end and capable of being rotated, a threaded disk in contact with the threaded rod such that the threaded disk moves at least one of upward toward the open end and downward toward the bottom end upon rotation of the threaded rod; and an attachable cap detachably mounted to and complementarily received at the open end of the barrel cavity, the attachable cap having an internal part; filling the barrel cavity with a beverage to be frozen;

inserting the internal part of the attachable cap into the open end of the barrel cavity to provide a tight seal and a uniformly shaped frozen beverage at any angle the barrel cavity is stored;

freezing the beverage to be frozen within the barrel cavity thereby molding a frozen beverage wherein the threaded disk is located below at least a portion of the frozen beverage; and rotating the threaded rod in a first direction to move the threaded disk and the frozen beverage upward toward the open end thereby dispensing the frozen beverage at the open end of the barrel cavity.

24. The method of claim 23, wherein prior to freezing the beverage to be frozen, the method further comprises rotating the threaded rod in a second direction opposite the first direction such that the threaded disk retracts to the bottom end of the barrel cavity and wherein after dispensing a portion of the frozen beverage, the method further comprises:

rotating the threaded rod in the second direction such that a remaining portion of the frozen beverage is retracted within the barrel cavity whereby the remaining portion is stored in the barrel cavity for future consumption.

25. The method of claim 24, wherein the first direction comprises a counter-clockwise direction and the second direction comprises a clockwise direction.

* * * * *